US011647876B1

(12) United States Patent
Carmona

(10) Patent No.: US 11,647,876 B1
(45) Date of Patent: May 16, 2023

(54) FLUSHABLE TOILET SEAT COVER

(71) Applicant: Michael B. Carmona, Agoura Hills, CA (US)

(72) Inventor: Michael B. Carmona, Agoura Hills, CA (US)

( * ) Notice: Subject to any disclaimer, the term of this patent is extended or adjusted under 35 U.S.C. 154(b) by 0 days.

(21) Appl. No.: 17/975,094

(22) Filed: Oct. 27, 2022

Related U.S. Application Data

(63) Continuation-in-part of application No. 17/172,158, filed on Feb. 10, 2021, now abandoned.

(51) Int. Cl.
*A47K 13/08* (2006.01)
*A47K 13/16* (2006.01)

(52) U.S. Cl.
CPC ..... *A47K 13/08* (2013.01); *A47K 13/16* (2013.01)

(58) Field of Classification Search
CPC ..... A47K 13/08; A47K 13/16; A47K 13/18
USPC ..... 4/245.8, 245.9, 300.3, 144.2, 144.3
See application file for complete search history.

(56) References Cited

U.S. PATENT DOCUMENTS

| | | | | | |
|---|---|---|---|---|---|
| 1,702,070 | A * | 2/1929 | Young | A47K 13/16 | 4/245.9 |
| 4,766,617 | A * | 8/1988 | Thygesen | A47K 13/16 | 4/245.4 |
| 4,975,990 | A * | 12/1990 | Chan | A47K 13/16 | 4/245.9 |
| 7,356,855 | B1 * | 4/2008 | Morad | A47K 13/16 | 4/245.3 |
| 2006/0090250 | A1 * | 5/2006 | Bolles | A47K 10/16 | 4/144.2 |
| 2007/0209099 | A1 * | 9/2007 | Issachar | A47K 13/18 | 4/245.1 |

* cited by examiner

*Primary Examiner* — Tuan N Nguyen
(74) *Attorney, Agent, or Firm* — Quickpatents, LLC; Kevin Prince

(57) ABSTRACT

A toilet training device and seat cover has a perforated hole and may or may not have flap which can be folded and glued or taped to make funnel. Once in use, the user pushes out the hole with a flap still attached so as to bridge over rim of dirty toilet. The seat cover may or may not have side folds for more surface area to wrap over toilet seat. The toilet seat cover provides a user with hygiene protection that often is ignored. A plurality of toilet seat covers may be packaged in a toilet seat cover dispenser that may be sized to fit in a pocket or purse and that may accommodate multiple seats covers in a folded and rolled position.

9 Claims, 5 Drawing Sheets

FLUSHABLE TOILET SEAT COVER

CROSS-REFERENCE TO RELATED APPLICATIONS

This application is a Continuation-in-Part of U.S. Utility patent application Ser. No. 17/172,158, filed on Feb. 10, 2021, and is incorporated herein by reference.

BACKGROUND OF THE INVENTION

1. Field of the Invention

Embodiments disclosed herein generally relate to methods, apparatus and systems for toilet training devices and more particularly to an improved toilet training device and method of utilizing the same which is characterized by use of a biodegradable and flushable paper element adapted to form hole/s for assisting young boys to aim accurately over the toilet rim and urinate into the toilet.

2. Description of Prior Art and Related Information

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

toilet training children can be quite difficult especially when teaching a male child to urinate. The parent's biggest challenge is to persuade their child to use the toilet when they need to urinate. The next biggest challenge is to teach the child, particularly boys, to sanitarily use the toilet. Part of the maturing process for a male toddler going from diapers to underwear is learning to urinate into a toilet or urinal. Generally, for boys, the transition from diapers to underwear occurs at the age of two to three years old. Typically, at this age boys do not have a very long attention span and their hand and eye coordination has not fully developed. As a result, male toddlers in the beginning stages of learning to urinate into a toilet or urinal have very poor aim and more often than not their stream of urine does not make it in the toilet but instead hits the walls, floors and even in some cases on the ceiling. Over time this creates a putrid smell of urine in the bathroom and creates unsanitary conditions if not sanitized properly. The problem of teaching male toddlers to aim their stream of urine into the toilet has occurred since this invention of the toilet with various ways of teaching the toddlers to aim their urine into the toilet or urinal.

Sometimes cereal is placed in the toilet bowl and the toddlers are instructed to aim at the cereal and hit the cereal with their stream of urine. This method of teaching works well because the toddler has a target to hit and is concentrating on hitting the target. However, the problem with the cereal method of teaching urination is that cereal has to be placed in the toilet each time prior to urination and toddlers are not very reliable of placing cereal in the toilet each time they have to urinate, especially when the call to urinate is urgent. The other problem with this method is that when the cereal floats to the side of the toilet bowl the chance the stream of urine will end up on the exterior of the toilet bowl is greatly increased due to the toddler's lack of hand and eye coordination.

Furthermore, the parents and care givers of toilet-trained little boys, or boys in the process of "toilet training", are often horrified by the prospect of their little boys having to lean their naked thighs and/or penis against or on top of the toilet rim of a dirty toilet or urinal to be able to reach the toilet. Public toilets are notorious for showing evidence of missed prior urinations. Everyone has witnessed this disgusting, unsanitary situation.

In short, everybody cringes at needing to sit on a public unsanitary, dirty toilet without some intervening protection between their skin and the toilet seat. There already exists the common disposable paper toilet seat cover available in many public and private locations and multiple inventions that have been proposed in prior art regarding training methodologies for young children and providing sanitary environment. A U.S. Pat. No. 5,117,515A on Toilet training device and method of use is issued to Moreno J. White, Jr, Wendy White. The patent is on an improved toilet training device and method of utilizing the same is disclosed characterized by use of a thin paper stock element adapted to float in a planar configuration upon the water surface within the toilet bowl for prolonged duration and upon contact with urine, rapidly sink within the toilet bowl and become flushable through the toilet bowl waste drain system. The element is preferably provided with indicia printed on both sides thereof representing a target or other geometric shape normally familiar to children and thereby attract the attention of a child and encourage toilet training.

Another patent on Toilet training device bearing U.S. Pat. No. 6,772,454B1 is issued to Gregory Thomas Barry Thomas Jackson Barry. The patent is on a toilet training device that has a target sensor for sensing an impact of urine, a first suction cup for securing the target sensor to a toilet, a music box for providing a feedback, and an insulated electric wire for connecting the target sensor with the music box. The target sensor can be positioned unobtrusively within the toilet. When a user urinates, the target sensor detects an impact of the urine when hit, and the target sensor triggers music in the music box through the insulated electric wire.

Another U.S. Pat. No. 5,369,820A on Toilet training potty is issued to Shirley J. Blount. The present invention comprises a potty seat configured with a hinged platform ring upon which a toilet training child is to sit, a collecting basin able to fit within a substantially hollow base of said potty seat, a pair of laterally disposed arms and a simulative tank connecting between the arms toward the rear. A first pair of lights is recessed within the arms of the potty seat. A second light or pair of lights is recessed within the tank portion. A pair of serially connected switches are mounted respectively beneath the platform ring and beneath the collecting basin so as to be closed when a weight is pressed down on each switch and thus electrically connected to activate the first pair of lights. Another switch is connected to a simulated flush handle and, when pivoted by the user, to activate the second light or lights. Thus, the lighting acts to positively respond to the child user carrying on the desired acts and learning proper toilet use.

A Toilet training apparatus and method bearing U.S. Pat. No. 5,573,407A is issued to Beverly Dunford. The patent is on an apparatus and method for training a child to complete a toilet training experience. The invention includes an object placed in close proximity to a toilet appropriate for training the child. The invention also includes a device for emitting a musical sound. Upon successful completion of a toilet training experience, the child is provided a reward token, such as a coin. The child may then place the token into the object, which may comprise a piggy bank. In response to placement of the token into the object, the music emitting device generates a musical sound. The method allows the child to associate the object visually with the training experience and to associate the musical sounds audibly with the training experience.

Another patent on Methods for improving the effectiveness of toilet training bearing U.S. Pat. No. 6,250,929B1 is issued to Kimberly Clark Worldwide Inc. The patent is on a method for improving the effectiveness of a child's toilet training regime utilizes a progress scale to evaluate the child's current level or stage of toilet training. Recommendations for improving the effectiveness of the child's training regime are divided into a plurality of unique groups corresponding to a plurality of stages of toilet training. The child's toilet training progress value, determined using the progress scale, is matched to a particular stage of training and the unique group of recommendations corresponding to the child's stage of training are selected. Methods for comparing the effectiveness of various toilet training regimes are also disclosed.

Another U.S. Pat. No. 8,291,526B2 on Portable and adjustable multipurpose toilet training device is issued to Goli Parvizian. The patent is on a device for facilitating use of a bathroom fixture according to various exemplary embodiments can include at least a first planar body and a second planar body having a pair of opposed legs extending from each planar body defining a first opening and a second opening for receiving and conforming to a configuration of a base of a bathroom fixture. An interlocking element may be interposed between at least the first planar body and the second planar body for interlocking and stacking at least the first and second planar bodies to form a raised platform adjustable to a predetermined height based upon a user's height for facilitating use of the bathroom fixture according to the user's height. A skid-resistance bottom surface may be provided on either the first planar body or the second planar body for securing the raised platform to an underlying surface to prevent movement.

There are multiple inventions that have been proposed in prior art regarding bringing an advancement and enhanced utility regarding training systems for little boys or girls. However, the utilization of these systems in daily life are quite cumbersome and non-effective. Moreover, the features of these utility system are quite limited.

Therefore, a need exists for a novel assembly which improves the arrangements in similar field. The invention focuses on providing a utility item for small boys to more accurately aim and urinate into the toilet and provides an additional sanitary protection when sitting on the toilet. It further helps to prevent wetting clothing, shoes, walls and floors from errant sprays or drips of urine. The proposed invention can also be used for men with urinary problems such as enlarged prostate whereby often the flow of urine is dramatically reduced causing much splattering, dribbling and drips while urinating.

None of the previous inventions and patents, taken either singly or in combination, is seen to describe the instant invention as claimed. Hence, the inventor of the present invention proposes to resolve and surmount existent technical difficulties to eliminate the aforementioned shortcomings of prior art.

SUMMARY OF THE INVENTION

In light of the disadvantages of the prior art, the following summary is provided to facilitate an understanding of some of the innovative features unique to the present invention and is not intended to be a full description. A full appreciation of the various aspects of the invention can be gained by taking the entire specification, claims, drawings, and abstract as a whole.

It is a general object of the present invention to provide an improved form of assembly which relates to an incorporate new strategy and uses with minor modifications to the existing simple toilet seat cover model.

The present subject disclosure provides novel training devices which serve to boost the confidence of a toddler in training by providing a stable platform for any person, most commonly a small male child.

It is also the objective of the invention to provide a toilet seat cover assembly which shields and protect individuals from direct contact with the dirty toilet rims, seats or urinals as they approach and use the toilet. It provides a splash-suppressing device which blocks splashes, when and if they occur, from contacting the human body or clothing, or contaminating the toilet.

It is moreover the objective of the invention to provide an assembly which has a funnel like structure where funneling the flow or spray of urine directly into the toilet or urinal will avoid splashes or drops of urine on seat, floor, shoes or clothes.

It is further the objective of the invention to provide a smart assembly which not only acts as an additional sanitary buffer protection against a person from coming in contact with the toilet seat or rim, but also helps collect and direct the urine that doesn't flow in the desired direction which can be the sprays, dribbles or sideways spurts.

It is furthermore the objective of the invention to provide ease to individuals with a urinary issue, such as a reduced flow of urine. By using the proposed assembly, clothing can be protected from getting wet after errant urine flow.

It is also the objective of the invention to provide an assembly where the design allows the penis to protrude beyond the vertically held toilet seat cover which shields the boy's legs/thighs or adult senior male's, clothing, while allowing him to urinate as usual.

It is still the objective of the invention to provide an assembly which is decorative in nature and the holes or perforations can be in any design including but not limited to stars, circles, squares, diamonds that allows the boy's penis or adult man's penis to penetrate the paper seat cover.

It is also the objective of the invention to provide an assembly preferably made of paper and it can be colored, painted, have unicorns and hearts on it, or any other famous designs.

It is further the objective of the invention to provide an assembly which provides ease in portability and operational use of product.

Other aspects, advantages and novel features of the present invention will become apparent from the detailed description of the invention when considered in conjunction with the accompanying drawings.

Embodiments of the present invention provide a method of protecting a user from contacting a toilet seat, toilet bowl or urinal comprising accessing a toilet seat cover device, the toilet seat cover device having a first perforation defining a first opening when the first perforation is opened, the toilet seat cover device having a second perforation defining a second opening when the second perforation is opened; opening the first perforation and placing the toilet seat cover device on top of the toilet seat when the user chooses to sit on the toilet seat during use; and opening the second perforation and placing the toilet seat cover device along a front surface of the toilet bowl or urinal when the user chooses to stand in front of the toilet bowl or urinal during use.

Embodiments of the present invention further provide a method for providing a barrier between a user and a toilet bowl, toilet rim or urinal comprising accessing a toilet seat cover device, the toilet seat cover device having a first perforation defining a first opening when the first perforation is opened, the toilet seat cover device having a second perforation defining a second opening when the second perforation is opened; and opening the second perforation and placing the toilet seat cover device vertically along a front surface of the toilet bowl or urinal when the user chooses to stand in front of the toilet bowl or urinal during use.

Embodiments of the present invention also provide a toilet seat cover device comprising a flat sheet material; first perforation in the flat sheet material defining a first opening when the first perforation is opened; and a second perforation defining a second opening when the second perforation is opened, wherein the first perforation is shaped in a pear shape; a narrow end of the pear shape is without perforations; the pear shape has a larger diameter end directed toward a rear edge of the toilet seat cover device; the second perforation is disposed between the larger diameter end of the pear shape of the first perforation and the rear edge of the toilet seat cover device; and the second perforation is smaller than the first perforation This Summary is provided merely for purposes of summarizing some example embodiments, so as to provide a basic understanding of some aspects of the subject matter described herein. Accordingly, it will be appreciated that the above-described features are merely examples and should not be construed to narrow the scope or spirit of the subject matter described herein in any way. Other features, aspects, and advantages of the subject matter described herein will become apparent from the following Detailed Description, Figures, and Claims.

BRIEF DESCRIPTION OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention and explain various principles and advantages of those embodiments.

Figure 1:
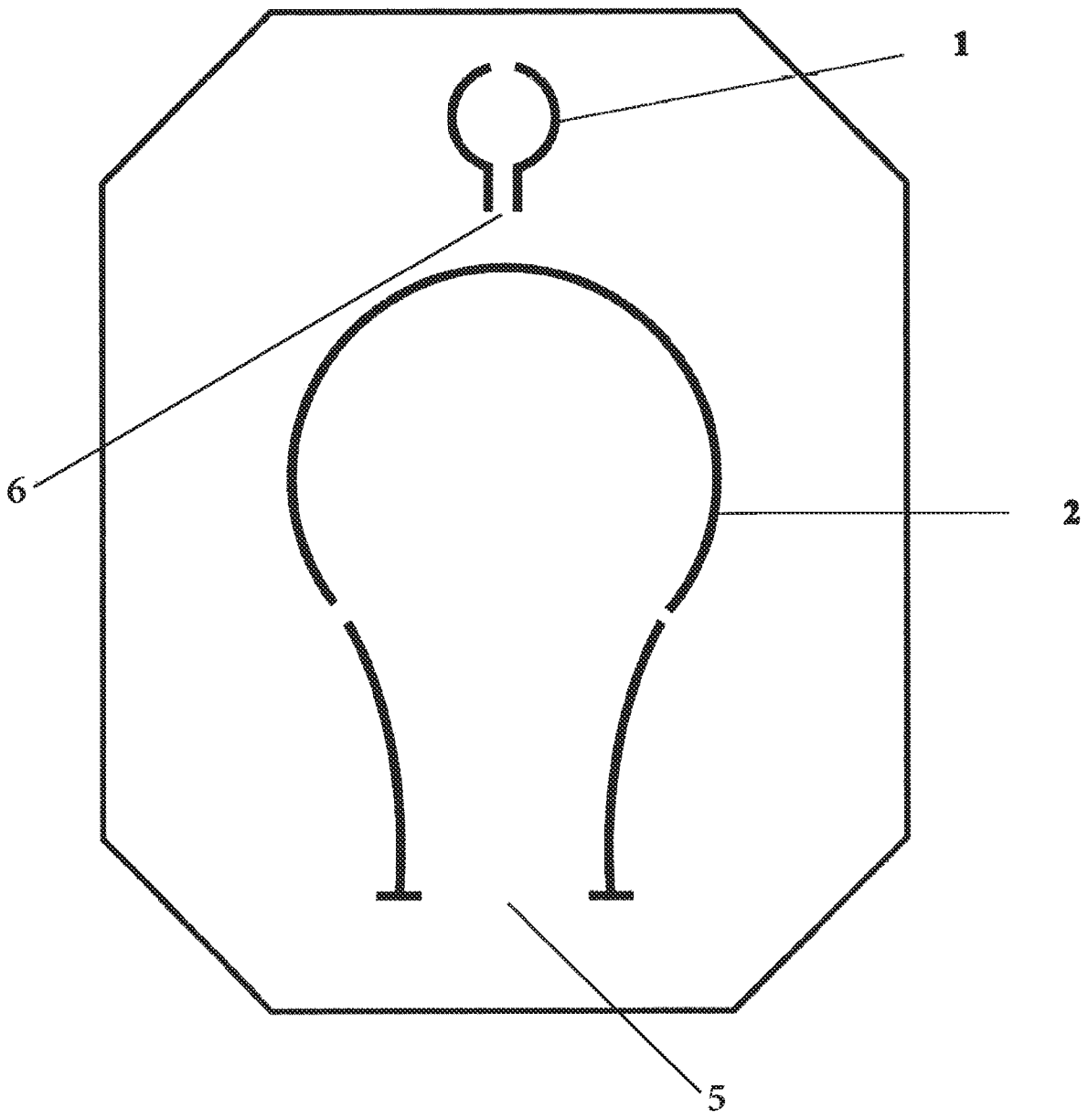
FIG. 1 illustrates the view of one design of invention, in accordance with an embodiment of the present disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Reference will be made in detail to selected embodiments of the present disclosure in conjunction with accompanying figures. The embodiments described herein are not intended to limit the scope of the disclosure, and the present disclosure should not be construed as limited to the embodiments described. This disclosure may be embodied in different forms without departing from the scope and spirit of the disclosure. It should be understood that the accompanying figure is intended and provided to illustrate embodiments of the disclosure described below and are not necessarily drawn to scale. In the drawing, like numbers refer to like elements throughout, and thicknesses and dimensions of some components may be exaggerated for providing better clarity and ease of understanding.

It should be noted that the terms "first", "second", and "like", herein do not denote any order, ranking, quantity, or importance, but rather are used to distinguish one element from another. Further, the terms "a" and "an" herein do not denote a limitation of quantity, but rather denote the presence of at least one of the referenced item.

The current invention proposes an advance approach which utilizes the funneling approach where the flow or spray of urine directly goes into the toilet or urinal. This approach not only acts as an additional sanitary buffer protection for a person from coming in contact with the toilet seat or rim, but also helps collect and direct the urine that doesn't flow in the desired direction. It avoids the sprays, dribbles or sideways spurts where the by providing this advance methodology.

The most basic design of current invention uses a modified common standard disposable, biodegradable flushable toilet seat cover (one such prior art U.S. Pat. No. 4,975,990A). Located anywhere along the edges of the toilet seat cover would be a hole or a perforation or multiple holes or perforations where the boy can place his penis through and drape the remaining toilet seat cover down over his body below his penis. This basic design allows the penis to protrude beyond the now vertical toilet seat cover (as opposed to the regular horizontal toilet seat cover use) which covers the boy's legs/thighs, clothing, etc. while allowing him to urinate as usual.

The invention as per its preferred embodiments can be used for adult man who can use the invention to shield against errant sprays, dribbles, drips from dirtying his clothing and shoes.

The holes or perforations of flushable toilet seat can be in any design including but not limited to star, circle, square, diamond that allows the boy's penis to penetrate the paper seat cover. To further entice the little boy to use the flushable toilet seat, and for commercial reasons, since the entire apparatus is made of paper, it can be colored, painted, have unicorns and hearts on it, or any designs. Use instructions, signage or text of any kind can be applied onto the broad surface of the flushable toilet seat. Since these are made from a thin paper-like product, it can be folded, packaged in smaller personal containers and quantities that can be carried in a purse or diaper bag.

The flushable toilet seat as per its further embodiments is used by people of all ages and both sexes basically for sanitary reasons when using a toilet. It not only protects the user from direct contact to dirty, unsanitary toilets, but it also helps mitigate making toilets dirty and unsanitary. As the proposed assembly is made of thin disposable biodegradable flushable material, which can be folded and are easily carried in a purse or diaper bag, and can be used anywhere where there are toilets, In public or private locations.

Figure 2:
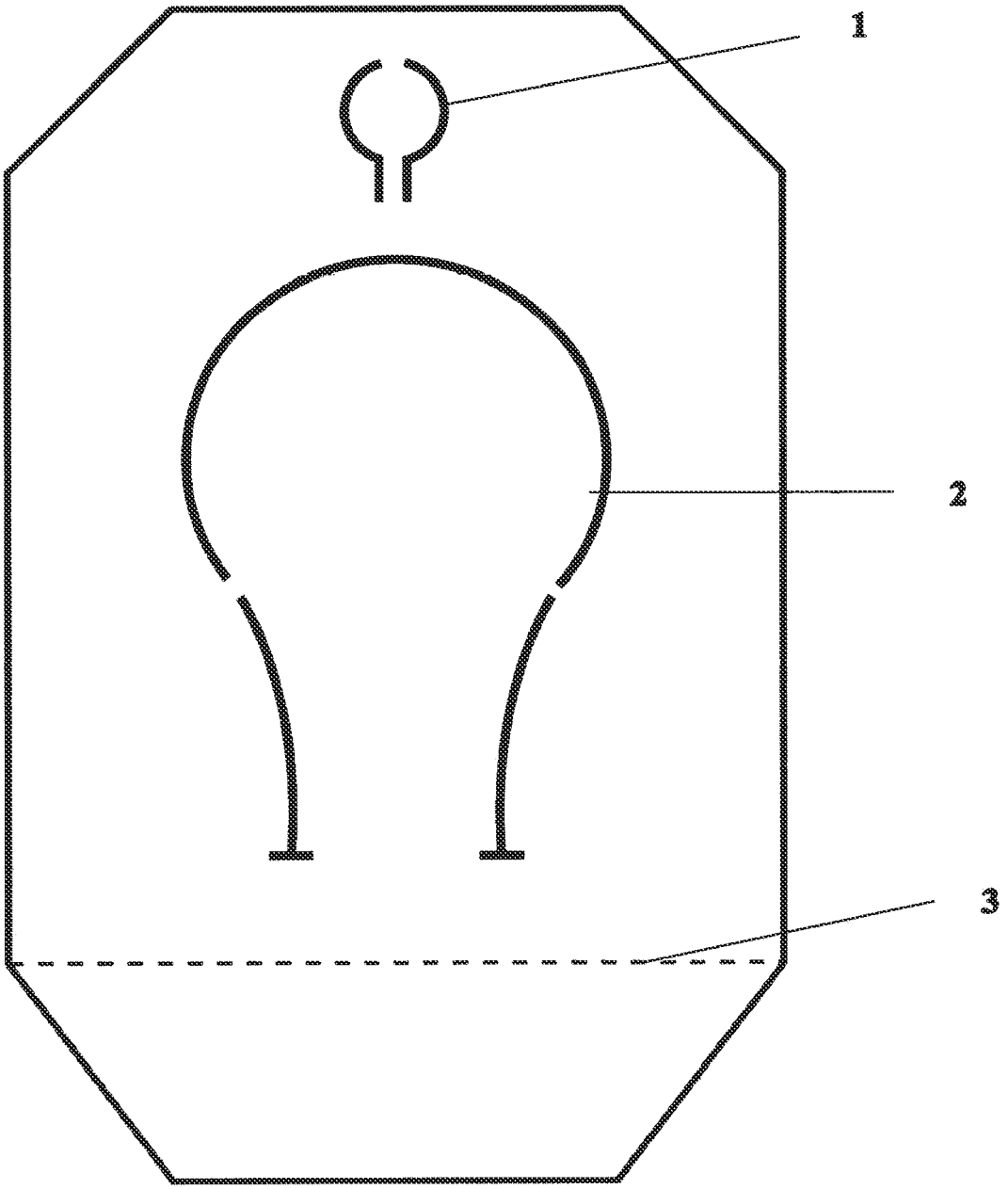
FIG. 2 illustrates the assembly with flap to form funnel for assistance during urination, in accordance with an embodiment of the present disclosure.
Figure 3:
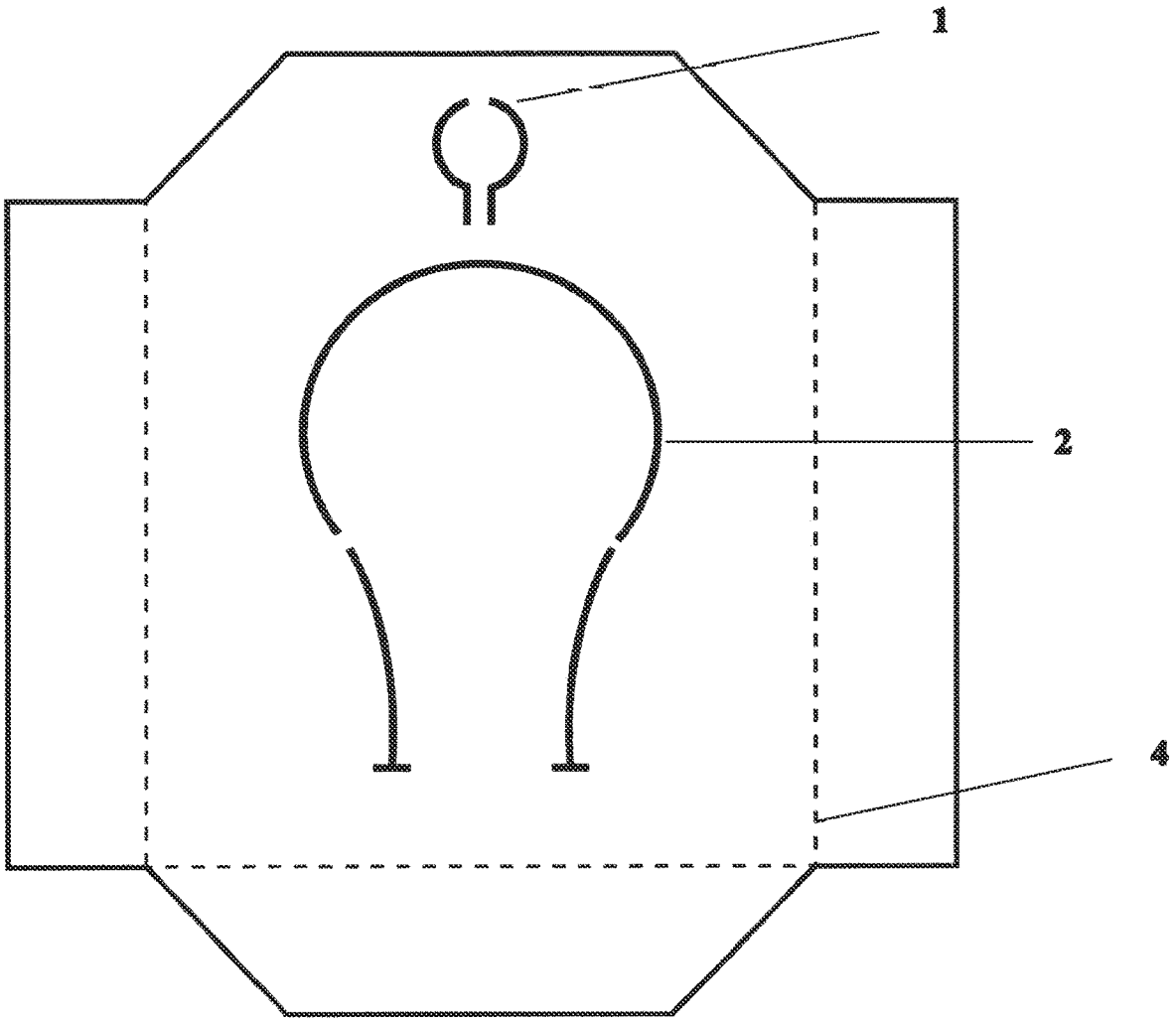
FIG. 3 illustrates another view of seat cover assembly with side folded extension lines to present more surface area to wrap over toilet seat, in accordance with an embodiment of the present disclosure.

Detailed reference will now be made to the preferred embodiment of the present invention, examples of which are illustrated in FIGS. 1-5. By looking at FIG. 1 which illustrates the view of one design of invention, in accordance with an embodiment of the present disclosure. A punchout perforated hole (1) can be seen located at anterior side of flushable toilet seat cover which can be used by small boys, to protrude penis over toilet seat. The seat cover punchout (2) hangs into toilet. FIG. 2 illustrates another addition to design of invention, where folded line shows flap (3) to form funnel for assistance during urination. The punchout perforated hole (1) may remain attached at non-perforated region (6) after opening the perforation, thus creating a hanging flap that can cover the rim of the toilet bowl, for example. The paper seat cover can be folded up allowing to form funnel through which person can urinate while seated. FIG. 3 illustrates another view of seat cover assembly, where side folded extension lines (4) can be seen. These side folds present more surface area to wrap over toilet seat.

Figure 4:
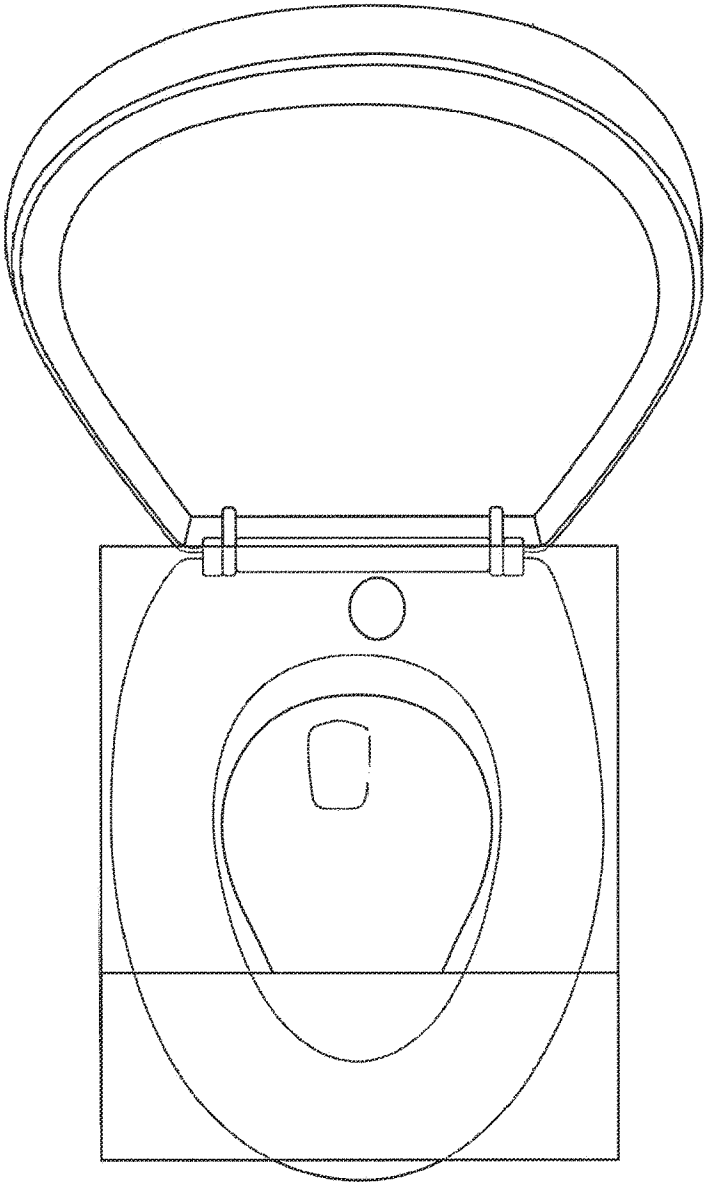
FIG. 4 shows the perspective use of assembly in accordance with an embodiment of the present disclosure.
Figure 5:
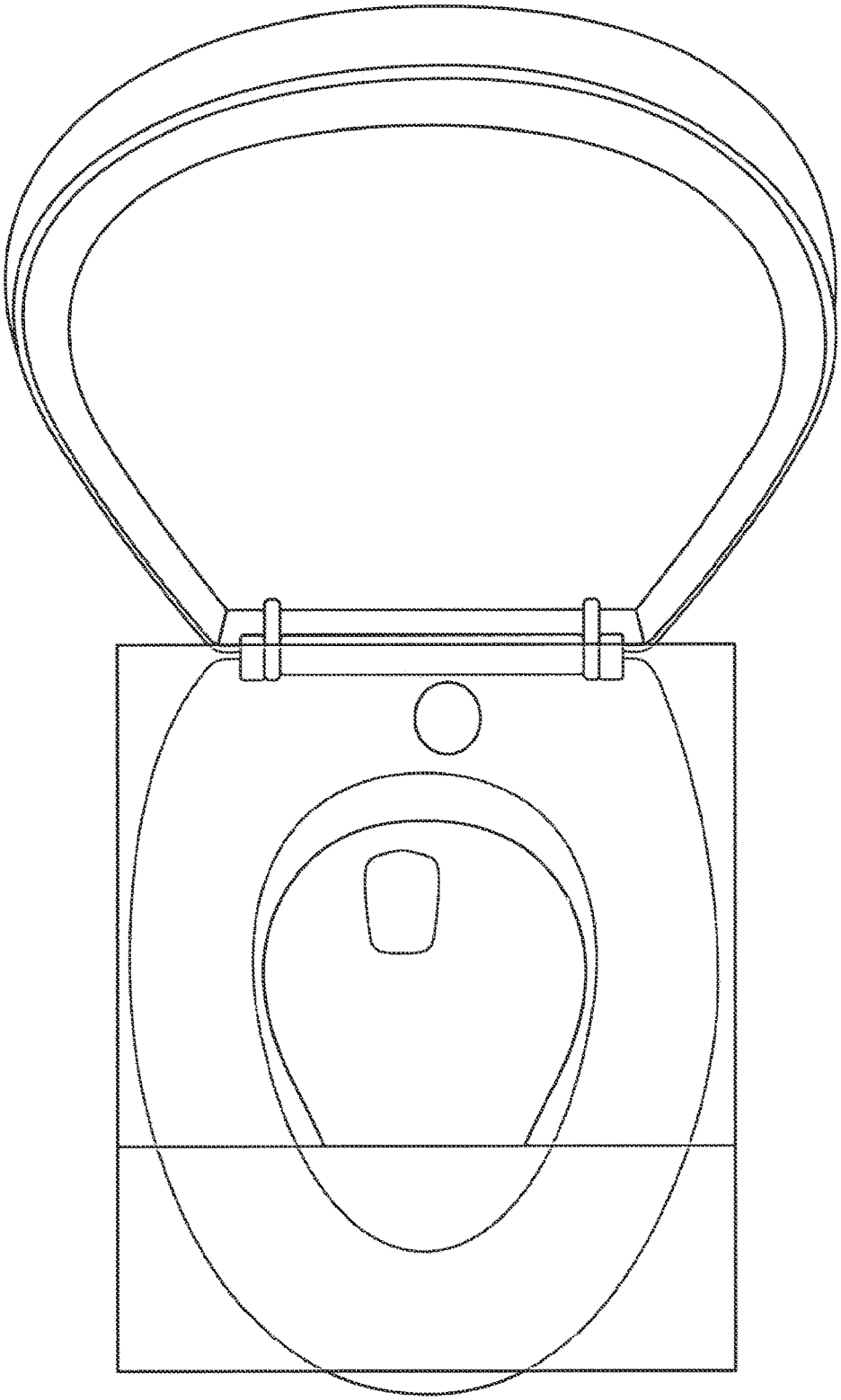
FIG. 5 illustrates another view of seat cover assembly used at bathroom seat, in accordance with an embodiment of the present disclosure.

FIG. 4 shows the perspective use of assembly in accordance with an embodiment of the present disclosure. FIG. 5 illustrates another view of seat cover assembly used at bathroom seat, in accordance with an embodiment of the present disclosure.

Accordingly, while only a few embodiments of the present invention have been shown and described, it is obvious that many changes and modifications may be made again without departing from the spirit and scope of the invention.

While a specific embodiment has been shown and described, many variations are possible. With time, additional features may be employed. The particular shape or configuration of the platform or the interior configuration may be changed to suit the system or equipment with which it is used.

Having described the invention in detail, those skilled in the art will appreciate that modifications may be made to the invention without departing from its spirit. Therefore, it is not intended that the scope of the invention be limited to the specific embodiment illustrated and described. Rather, it is intended that the scope of this invention be determined by the appended claims and their equivalents.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

What is claimed is:

1. A method of protecting a user from contacting a toilet seat, toilet bowl or urinal, the method comprising:

accessing a toilet seat cover device, the toilet seat cover device having a first perforation defining a first opening when the first perforation is opened, wherein the first perforation is shaped in a pear shape having a larger diameter end directed toward a rear edge of the toilet seat cover device, the toilet seat cover device having a second perforation defining a second opening when the second perforation is opened, wherein the second perforation is disposed between the larger diameter end of the pear shape of the first perforation and the rear edge of the toilet seat cover device;

opening the first perforation and placing the toilet seat cover device on top of the toilet seat when the user chooses to sit on the toilet seat during use; and opening the second perforation and placing the toilet seat cover device along a front surface of the toilet bowl or urinal when the user chooses to stand in front of the toilet bowl or urinal during use.

2. The method of claim 1, wherein the step of opening the second perforation includes partially opening the second perforation to permit the interior region within the second perforation to act as a flap to contact a rim of the toilet bowl or urinal.

3. The method of claim 2, wherein the toilet seat cover device is disposed vertically during use thereof.

4. The method of claim 1, wherein a narrow end of the pear shape is without perforations.

5. A method for providing a barrier between a user and a toilet bowl, toilet rim or urinal, the method comprising:

accessing a toilet seat cover device, the toilet seat cover device having a first perforation defining a first opening when the first perforation is opened, wherein the first perforation is shaped in a pear shape having a larger diameter end directed toward a rear edge of the toilet seat cover device, the toilet seat cover device having a second perforation defining a second opening when the second perforation is opened, wherein the second perforation is disposed between the larger diameter end of the pear shape of the first perforation and the rear edge of the toilet seat cover device; and opening the second perforation and placing the toilet seat cover device vertically along a front surface of the toilet bowl or urinal when the user chooses to stand in front of the toilet bowl or urinal during use.

6. The method of claim 5, wherein the step of opening the second perforation includes partially opening the second perforation to permit the interior region within the second perforation to act as a flap to contact a rim of the toilet bowl or urinal.

7. The method of claim 5, wherein a narrow end of the pear shape is without perforations.

8. A toilet seat cover device comprising:

a flat sheet material;

a first perforation in the flat sheet material defining a first opening when the first perforation is opened; and a second perforation defining a second opening when the second perforation is opened, wherein the first perforation is shaped in a pear shape;

a narrow end of the pear shape is without perforations;

the pear shape has a larger diameter end directed toward a rear edge of the toilet seat cover device;

the second perforation is disposed between the larger diameter end of the pear shape of the first perforation and the rear edge of the toilet seat cover device; and the second perforation is smaller than the first perforation.

9. The toilet seat cover device of claim 8, wherein the second perforation is shaped in a round shape.

* * * * *